US011926953B2

(12) United States Patent
Seo et al.

(10) Patent No.: US 11,926,953 B2
(45) Date of Patent: Mar. 12, 2024

(54) WASHING MACHINE AND CLOTHES TREATING APPARATUS

(71) Applicant: SAMSUNG ELECTRONICS CO., LTD., Suwon-si (KR)

(72) Inventors: Dongpil Seo, Suwon-si (KR); Kanghyun Lee, Suwon-si (KR); Youngjin Cho, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/960,532

(22) Filed: Oct. 5, 2022

(65) Prior Publication Data

US 2023/0212807 A1 Jul. 6, 2023

Related U.S. Application Data

(63) Continuation of application No. PCT/KR2022/013927, filed on Sep. 19, 2022.

(51) Int. Cl.

| | |
|---|---|
| ***D06F 39/08*** | (2006.01) |
| ***D06F 33/42*** | (2020.01) |
| ***D06F 39/10*** | (2006.01) |

(52) U.S. Cl.

CPC ..... *D06F 39/085* (2013.01); *D06F 33/42* (2020.02); *D06F 39/10* (2013.01)

(58) Field of Classification Search

CPC ..... D06F 39/085; D06F 39/10; D06F 33/42

See application file for complete search history.

(56) References Cited

U.S. PATENT DOCUMENTS

| | | | | |
|---|---|---|---|---|
| 9,657,428 | B2 * | 5/2017 | Jeong | D06F 39/10 |
| 2013/0074554 | A1 * | 3/2013 | Chun | D06F 39/085 68/200 |
| 2017/0073878 | A1 * | 3/2017 | Xu | D06F 39/10 |
| 2020/0149209 | A1 * | 5/2020 | Nakashima | F04B 53/16 |

(Continued)

FOREIGN PATENT DOCUMENTS

| | | | | |
|---|---|---|---|---|
| CN | 104153162 | | 11/2014 | |
| CN | 109957937 | A * | 7/2019 | D06F 39/083 |
| CN | 108457052 | B | 3/2021 | |

(Continued)

OTHER PUBLICATIONS

Machine translation of CN 111676669 A to Zhao et al. (Year: 2020).*

(Continued)

*Primary Examiner* — Joseph L. Perrin

(74) *Attorney, Agent, or Firm* — STAAS & HALSEY LLP

(57) ABSTRACT

A washing machine includes a tub to receive water; a drain pump connectable to the tub and configured to discharge the water from the tub, and a filter assembly to filter the discharged water from the drain pump. The filter assembly includes a filter housing, a filter couplable to the filter housing and configured to rotate within the filter housing, the filter including a first filter structure to collect foreign substance from the discharged water from the drain pump and a second filter structure to collect other foreign substances having a size different from foreign substance collected in the first filter structure from the discharged water from the drain pump, and a filter driver to rotate the filter.

15 Claims, 15 Drawing Sheets

(56) References Cited

U.S. PATENT DOCUMENTS

2020/0399816 A1* 12/2020 Zhao ..... D06F 39/085

FOREIGN PATENT DOCUMENTS

| | | | |
|---|---|---|---|
| CN | 111676669 | B | 7/2021 |
| EP | 3 041 983 | B1 | 10/2017 |
| JP | 4667247 | | 4/2011 |
| JP | 5193588 | | 5/2013 |
| JP | 2020-39692 | | 3/2020 |
| KR | 10-0730923 | | 6/2007 |
| KR | 10-1375717 | | 3/2014 |
| KR | 10-2018-0082910 | | 7/2018 |
| WO | WO 2012/114245 | A1 | 8/2012 |

OTHER PUBLICATIONS

Machine translation of CN 108457052 A to Piao et al. (Year: 2018).*

International Search Report dated Jan. 12, 2023 in International PatentApplication No. PCT/KR2022/013927 (3 pages; 3 pages English translation).

PCT/ISA/237 dated Jan. 12, 2023 in International Patent Application No. PCT/KR2022/013927 (4 pages).

* cited by examiner

WASHING MACHINE AND CLOTHES TREATING APPARATUS

CROSS-REFERENCE TO RELATED APPLICATION(S)

This application is a continuation application, under 35 U.S.C. § 111(a), of International Application No. PCT/KR2022/013927, filed on Sep. 19, 2022, which claims priority to Korean Patent Application No. 10-2021-0193908, filed on Dec. 31, 2021, in the Korean Intellectual Property Office, the disclosure of which is incorporated by reference herein in its entirety.

BACKGROUND

1. Field

The disclosure relates to a washing machine and a clothes treating apparatus and more particularly to a washing machine and a clothes treating apparatus including a filter.

2. Description of Related Art

A washing machine is a household appliance that washes clothes, towels, and bedding. The washing machine may be classified into a drum type washing machine that washes laundry by repeating rising and falling of the laundry by rotating a drum, and a pulsator type washing machine that washes laundry using a water flow generated by a pulsator when a drum rotates.

A cycle performed by the washing machine may include wash, rinse, and spin-dry cycles regardless of the type of washing machine. The wash cycle supplies detergent water to a tub in which laundry is stored, and washes the laundry while rotating a drum. The rinse cycle supplies rinsing water to the tub and rinses the laundry by rotating the drum. The spin-dry cycle discharges water from the tub and removes water from the laundry by rotating the drum.

The washing machine may include a circulation flow path for circulating washing water when performing the wash cycle and/or the rinse cycle. The washing machine may include a drain flow path for draining washing water when performing the wash cycle, the rinse cycle, and/or the spin-dry cycle.

SUMMARY

In accordance with an aspect of the disclosure, a washing machine includes, a tub to receive water, a drain pump connectable to the tub and configured to discharge the water from the tub, and a filter assembly to filter discharged water from the drain pump. The filter assembly includes a filter housing, a filter couplable to the filter housing and configured to rotate within the filter housing, the filter including a first filter structure to collect foreign substances from the discharged water from the drain pump and a second filter structure to collect other foreign substances having a size different from foreign substance collected in the first filter structure from the discharged water from the drain pump, and a filter driver to rotate the filter.

The filter housing may include a circulation inlet connectable to the drain pump, a circulation outlet to discharge filtered water introduced through the circulation inlet to the tub, a drain inlet connectable to the drain pump, and a drain outlet to discharge filtered water introduced through the drain inlet to a drain hose formed to extend to an exterior of the washing machine.

The filter driver may be configured to rotate the filter to a first position in which the first filter structure communicates with the circulation inlet and the circulation outlet, or configured to rotate the filter to a second position in which the second filter structure communicates with the drain inlet and the drain outlet.

The filter may be located in the first position while the water of the tub is circulated, and the filter may be located in the second position while the water of the tub is discharged to the exterior of the washing machine.

The filter may include a filter case to which the first filter structure and the second filter structure are detachably mountable. The filter case may include a first filter receiving structure in which the first filter structure is receivable, a second filter receiving structure in which the second filter structure is receivable, and provided to be partitioned from the first filter receiving structure along a circumferential direction of the filter, and a through-member partitioned from the first filter receiving structure and the second filter receiving structure along the circumferential direction of the filter.

The filter may include a filter cap detachably couplable to the filter case so as to cover the first filter receiving structure, the second filter receiving structure, and the through-member, and a cap sealing structure to seal between the filter case and the filter cap.

The filter case may include a position adjuster. The filter housing may include a case guide to guide the position adjuster to allow the filter to be rotatable between the first position and the second position.

The through-member may be positioned to communicate with the drain inlet and the drain outlet in response to the first position of the filter, and the through-member may be positioned to communicate with the circulation inlet and the circulation outlet in response to the second position of the filter.

The filter may be located in the first position to allow the through-member to communicate with the drain inlet and the drain outlet in response to closing the second filter structure while the water of the tub is discharged to the exterior of the washing machine.

The first filter receiving structure may be larger than the second filter receiving structure.

The through-member may be smaller than the second filter receiving structure.

The filter case may include a first filter inlet formed to correspond to the circulation inlet in response to the first position of the filter, a first filter outlet formed to correspond to the circulation outlet in response to the first position of the filter, a second filter inlet formed to correspond to the drain inlet in response to the second position of the filter, a second filter outlet formed to correspond to the drain outlet in response to the second position of the filter, a through-inlet formed to correspond to the drain inlet in response to the first position of the filter, and a through-outlet formed to correspond to the drain outlet in response to the first position of the filter.

The first filter inlet and the first filter outlet may be formed in the first filter receiving structure, the second filter inlet and the second filter outlet may be formed in the second filter receiving structure, and the through-inlet and the through-outlet may be formed in the through-member.

The first filter structure may be provided to filter out foreign substances from the discharge water from the drain pump having a size larger than that of the second filter structure.

The filter assembly may be arranged below the tub to be adjacent to the drain pump.

In accordance with another aspect of the disclosure, a clothes treating apparatus includes a cabinet, a tub arranged inside the cabinet, a drain pump connected to the tub, a filter device provided to filter water flowing from the drain pump, and a controller configured to control the filter device. The controller is configured to control the filter device to allow water, which is supplied from the drain pump, to pass through a circulation flow path of the filter device so as to be filtered while washing water of the tub is circulated, and configured to control the filter device to allow water, which is supplied from the drain pump, to pass through a drain flow path of the filter device so as to be filtered while the washing water of the tub is discharged to an outside of the cabinet.

The filter device may include a first filter member arranged on the circulation flow path and a second filter member arranged on the drain flow path and provided to collect foreign substances having a size different from that of the first filter member.

The filter device may include a filter driving device configured to change a position of the first filter member and a position of the second filter member.

The filter device may include a circulation opening and closing device configured to open and close the circulation flow path, and a drain opening and closing device configured to open and close the drain flow path.

The filter device may be arranged at an upper rear side of the tub.

BRIEF DESCRIPTION OF THE DRAWINGS

The above and other aspects, features, and advantages of certain embodiments of the present disclosure will become apparent from the following description taken in conjunction with the accompanying drawings of which.

DETAILED DESCRIPTION

Figure 1:
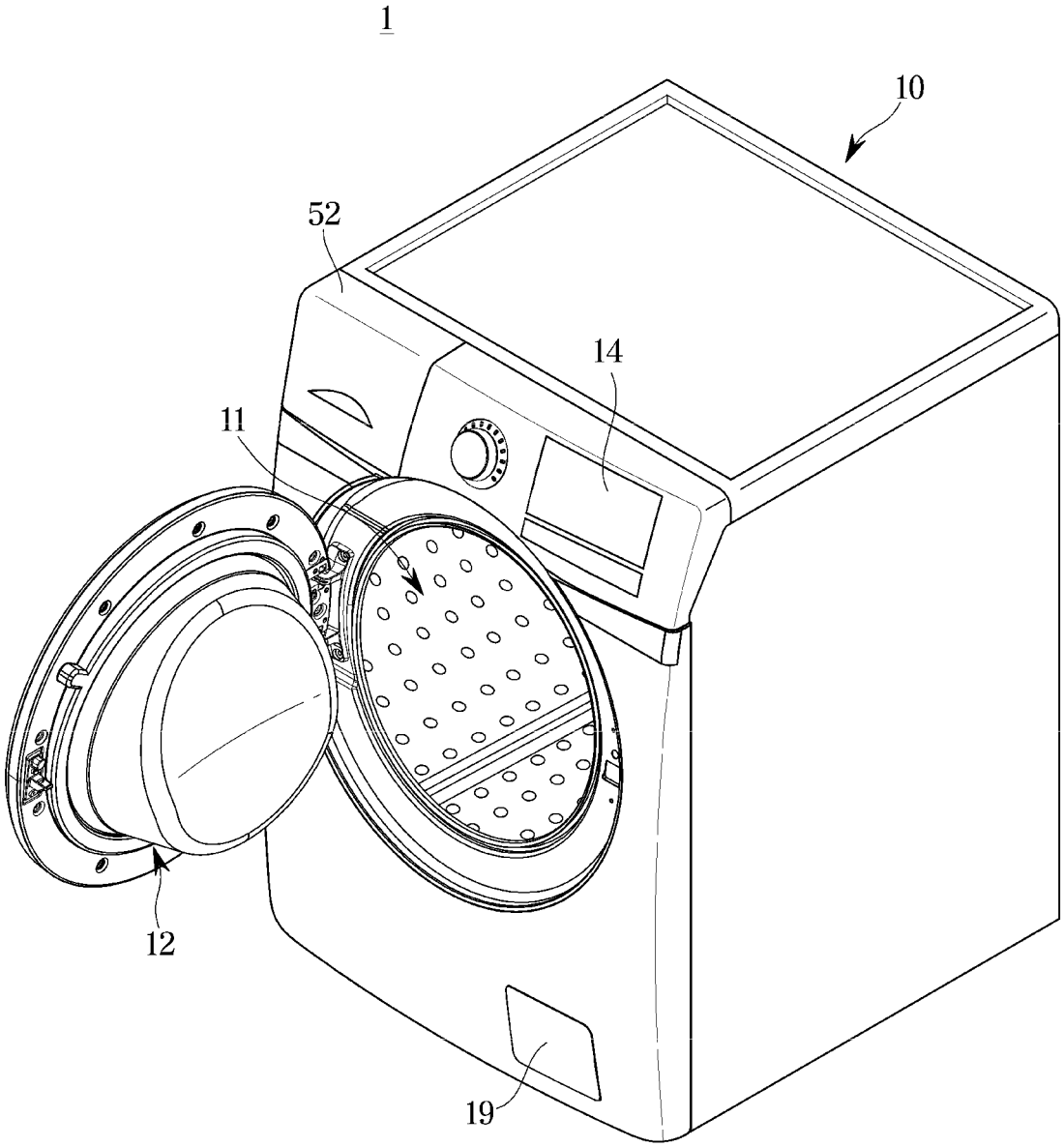
FIG. 1 illustrates a washing machine according to an embodiment of the disclosure.

Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function. The shapes and sizes of elements in the drawings may be exaggerated for a clear description.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

Therefore, it is an aspect of the disclosure to provide a washing machine and a clothes treating apparatus capable of including a filter provided to collect various sizes of foreign substances.

It is another aspect of the disclosure to provide a washing machine and a clothes treating apparatus capable of allowing washing water to selectively pass through one filter member among a plurality of filter members according to a situation.

It is another aspect of the disclosure to provide a washing machine and a clothes treating apparatus capable of reducing a space occupied by a filter while maintaining a performance of the filter.

Additional aspects of the disclosure will be set forth in part in the description which follows and, in part, will be obvious from the description, or may be learned by practice of the disclosure.

The disclosure will be described more fully hereinafter with reference to the accompanying drawings.

Figure 2:
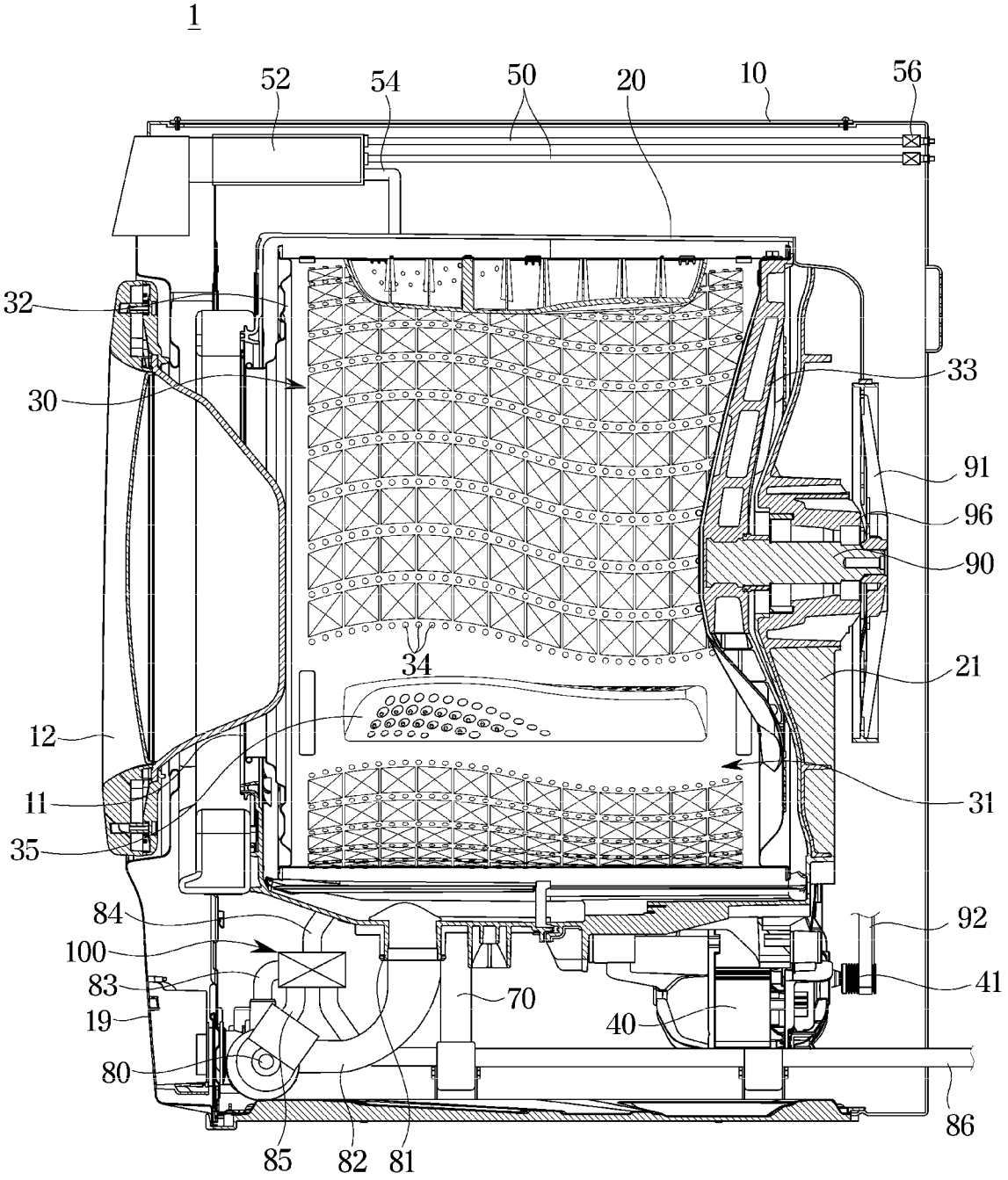
FIG. 2 illustrates a cross-section of the washing machine shown in FIG. 1.

FIG. 1 illustrates a washing machine according to an embodiment of the disclosure. FIG. 2 illustrates a cross-section of the washing machine shown in FIG. 1.

Referring to FIGS. 1 and 2, a washing machine 1 may include a cabinet 10 forming an exterior, a tub 20 arranged inside the cabinet 10, a drum 30 rotatably arranged inside the tub 20, and a drive motor 40 configured to drive the drum 30.

An inlet 11 may be formed in a front portion of the cabinet 10 to put laundry into the drum 30. The inlet 11 may be opened and closed by a door 12 installed on the front portion of the cabinet 10.

A water supply pipe 50 provided to supply washing water to the tub 20 may be provided above the tub 20. One side of the water supply pipe 50 may be connected to a water supply valve 56, and the other side of the water supply pipe 50 may be connected to a detergent box 52.

The detergent box 52 may be connected to the tub 20 through a connection pipe 54. Water supplied through the water supply pipe 50 may be supplied into the tub 20 together with the detergent via the detergent box 52.

The tub 20 may be supported by a damper 70. The damper 70 may connect an inner bottom surface of the cabinet 10 to an outer surface of the tub 20.

The drum 30 may include a cylindrical member 31, a front plate 32 arranged in front of the cylindrical member 31, and a rear plate 33 arranged at rear of the cylindrical member 31. An opening for inserting and withdrawing laundry may be formed in the front plate 32. A shaft 90 provided to transmit power of the drive motor may be connected to the rear plate 33.

A plurality of through-holes 34 may be formed around the drum 30 for distribution of washing water, and a plurality of lifters 35 may be installed on an inner circumferential surface of the drum 30 to allow the laundry to rise and fall in response to rotation of the drum 30.

The drum 30 and the drive motor 40 are connected through the shaft 90, and according to a connection method between the shaft 90 and the drive motor 40, the washing machine 1 may be classified into a direct drive type in which the shaft 90 is directly connected to the drive motor 40 so as to rotate the drum 30, and an indirect drive type in which a pulley 91 is connected to between the shaft 90 and the drive motor 40 so as to drive the drum 30.

The washing machine 1 according to an embodiment of the disclosure may be provided as the indirect drive type, but is not limited thereto. Therefore, technical features of the disclosure are applicable to the direct drive type.

One end of the shaft 90 is connected to the rear plate 33 of the drum 30, and the other end of the shaft 90 extends to the outside of a rear member 21 of the tub 20. The other end of the shaft 90 may be inserted into the pulley 91 in order to obtain a driving force from the drive motor 40. In addition, a motor pulley 41 is formed on a rotating shaft of the drive motor 40. A drive belt 92 is provided between the motor pulley 41 and the shaft pulley 91 and thus the shaft 90 may be driven by the drive belt 92.

The drive motor 40 may be arranged on one side of a lower portion of the tub and thus the drive motor 40 may drive the shaft 90 while the drive belt 92 is rotated clockwise or counterclockwise with respect to a vertical direction of the tub 20.

A bearing housing 96 is installed on the rear member 21 of the tub 20 to rotatably support the shaft 90. The bearing housing 96 may be formed of an aluminum alloy, and may be inserted into the rear member 21 of the tub 20 in a process in which the tub 20 is injection molded.

Further, a display 14 provided to display a state of the washing machine 1 to a user may be provided on a front upper portion of the cabinet 10. The display 14 may include an inputter. A printed circuit board assembly (not shown) may be provided on the front upper portion of the cabinet 10.

A cover 19 provided to cover a filter device 100 (also referred to as filter assembly 100) may be provided at a lower front of the cabinet 10. As a user opens the cover 19, the user can access the filter device 100.

The washing machine 1 may include a drain pump 80 arranged under the tub and configured to discharge water inside the tub 20 to an outside of the washing machine 1. In order to allow water inside the tub 20 to flow into the drain pump 80, the drain pump 80 may be connected to the tub 20 through a drain port 81 and a connection hose 82 of the tub 20.

The washing machine 1 may include the filter device 100 provided to filter water discharged from the drain pump 80. The filter device 100 may be arranged below the tub 20 to be adjacent to the drain pump 80. In order to supply water from the drain pump 80 to the filter device 100, the filter device 100 may be connected to the drain pump 80 through a first circulation hose 83 and a first drain hose 85. In order to allow water, which flows to the filter device 100 through the first circulation hose 83, to be filtered and then guided to the tub 20, the filter device 100 may be connected to the tub 20 through a second circulation hose 84. In order to allow water, which flows to the filter device 100 through the first drain hose 85, to be filtered and then guided to the outside of the cabinet 10, the filter device 100 may be connected to the second drain hose 86.

Figure 3:
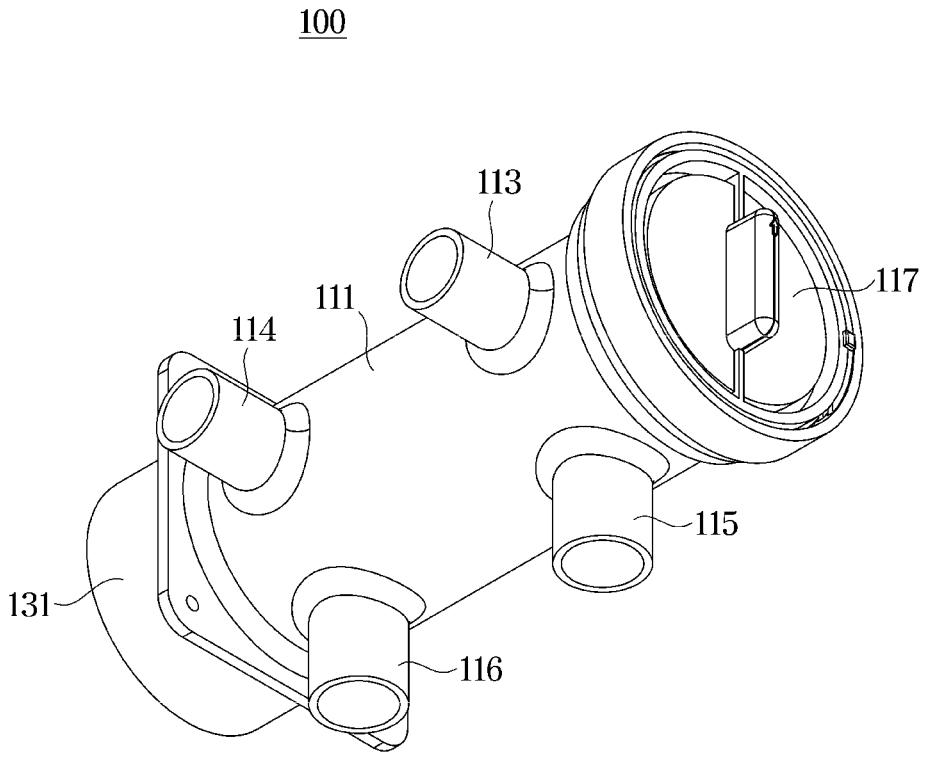
FIG. 3 illustrates a filter device shown in FIG. 2.
Figure 4:
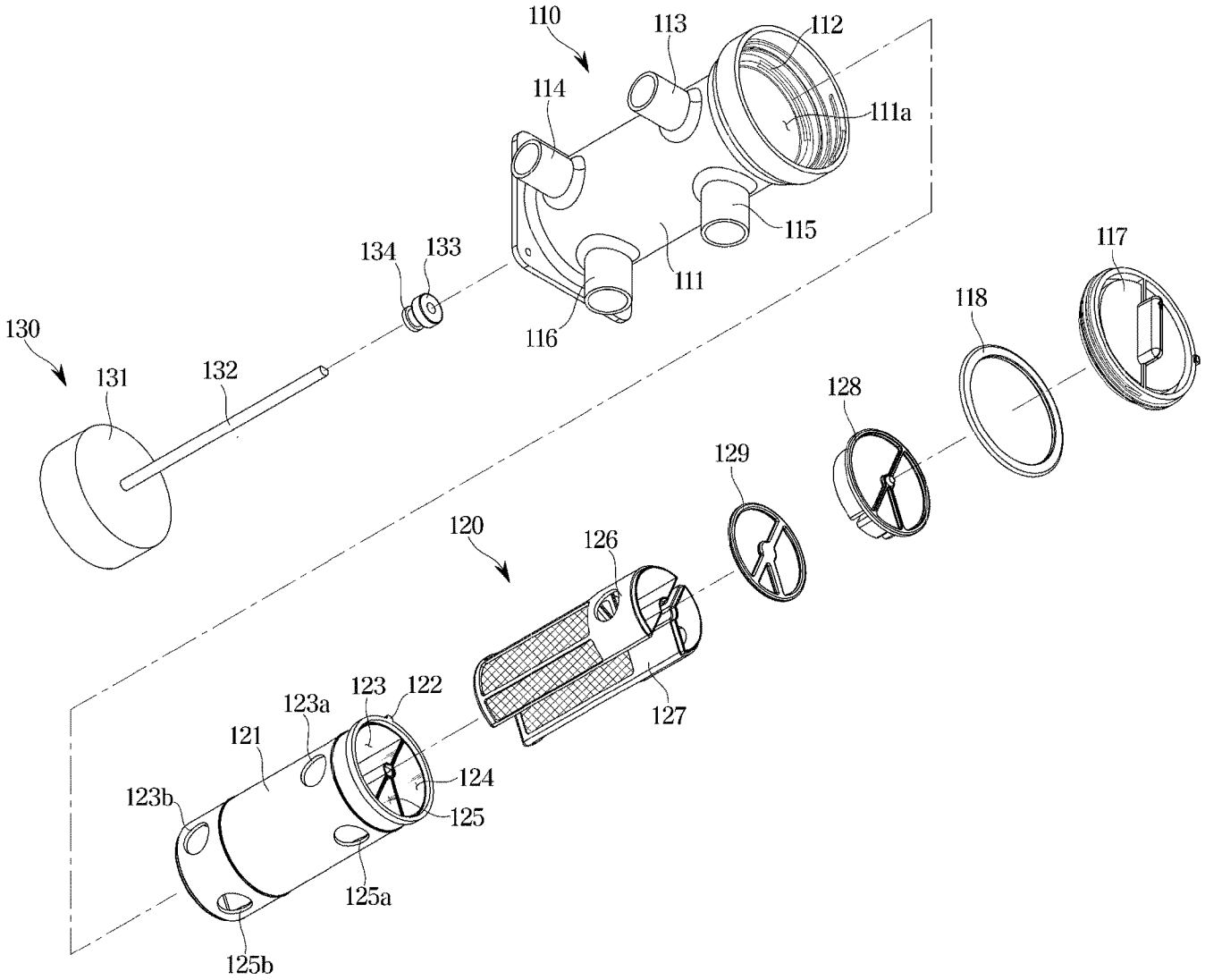
FIG. 4 illustrates an exploded view of the filter device shown in FIG. 3.

FIG. 3 illustrates a filter device shown in FIG. 2. FIG. 4 illustrates an exploded view of the filter device shown in FIG. 3.

Referring to FIGS. 3 and 4, the filter device 100 may include a filter housing 110, a filter 120 rotatably coupled to the filter housing 110, and a filter driving device 130 configured to rotate the filter 120.

The filter housing 110 may include a housing body 111 having a substantially cylindrical shape. A filter mounting member **111*a* may be formed in the housing body 111 to allow the filter 120** to be rotatably inserted thereinto.

A circulation inlet 113, a circulation outlet 114, a drain inlet 115, and a drain outlet 116 may be provided on an outer peripheral surface of the housing body 111.

The circulation inlet 113 may be connected to the drain pump 80 through the first circulation hose 83. Water discharged from the drain pump 80 may be introduced into the filter device 100 through the circulation inlet 113.

The circulation outlet 114 may be provided to discharge water, which flows into the filter device 100 through the circulation inlet 113, to the tub 20. The circulation outlet 114 may be connected to the tub 20 through the second circulation hose 84.

The drain inlet 115 may be connected to the drain pump 80 through the first drain hose 85. Water discharged from the drain pump 80 may flow into the filter device 100 through the drain inlet 115.

The drain outlet 116 may be provided to discharge water, which flows into the filter device 100 through the drainage inlet 115, to the outside of the cabinet 10. The drain outlet 116 may be connected to the second drain hose 86.

The filter housing 110 may include a case guide 112 provided to limit a rotation range of the filter 120. The case guide 112 may guide a position adjuster 122 of the filter 120. The case guide 112 may have a groove shape. As the case guide 112 guides the position adjuster 122, the filter 120 may be rotated between a first position for filtering water flowing from the drain pump 80 and for discharging the filtered water to the tub 20, and a second position for filtering water flowing from the drain pump 80 and for discharging the filtered water to the outside of the cabinet 10.

The filter housing 110 may include a housing cover 117 provided to cover the filter mounting member 111*a* of the housing body 111 in which the filter 120 is received.

The housing cover 117 may be detachably mounted to the housing body 111. The housing cover 117 may rotatably support the filter 120.

The filter housing 110 may include a housing sealing member 118 provided to seal a gap between the housing cover 117 and the housing body 111.

The filter 120 may include a first filter member 126 (also referred to as first filter structure 126) and a second filter member 127 (also referred to as second filter structure 127). The second filter member 127 may be provided to collect foreign substances having a size different from that of the first filter member 126. The first filter member 126 may be provided to filter out foreign substances having a size larger than that of the second filter member 127.

The filter 120 may include a filter case 121 to which the first filter member 126 and the second filter member 127 are detachably mounted. The filter case 121 may include a first filter receiving member 123 (also referred to as first filter receiving structure 123) in which the first filter member 126 is received, and a second filter receiving member 124 in which the second filter member 127 is received. The second filter receiving member 124 (also referred to as second filter receiving structure 124) may be provided to be partitioned from the first filter receiving member 123 along the circumferential direction of the filter 120. The first filter receiving member 123 may be provided to be larger than the second filter receiving member 124.

A circulation flow path may be formed inside the first filter receiving member 123. A drain flow path may be formed inside the second filter receiving member 124.

The filter 120 may include a through-member 125 partitioned from the first filter receiving member 123 and the second filter receiving member 124 along the circumferential direction of the filter 120. The through-member 125 may be smaller than the second filter receiving member 124.

The filter case 121 may include a first filter inlet 123*a* formed to correspond to the circulation inlet 113 in response to the first position of the filter 120 and a first filter outlet 123*b* formed to correspond to the circulation outlet 114 in response to the first position of the filter 120. The first filter inlet 123*a* and the first filter outlet 123*b* may be formed in the first filter receiving member 123.

The filter case 121 may include a second filter inlet 124*a* (refer to FIG. 6) formed to correspond to the drain inlet 115 in response to the second position of the filter 120 and a second filter outlet formed to correspond to the drain outlet 116 in response to the second position of the filter 120. The second filter inlet 124*a* and the second filter outlet may be formed in the second filter receiving member 124.

The filter case 121 may include a through-inlet 125*a* formed to correspond to the drain inlet 115 in response to the first position of the filter 120 and a through-outlet 125*b* formed to correspond to the drain outlet 116 in response to the first position of the filter 120. The through-inlet 125*a* and the through-outlet 125*b* may be formed in the through-member 125.

The filter 120 may include a filter cap 128 detachably coupled to the filter case 101 so as to cover the first filter receiving member 123, the second filter receiving member 124, and the through-member 125.

The filter 120 may include a cap sealing member 129 (also referred to as cap sealing structure 129) provided to seal between the filter case 121 and the filter cap 128.

The filter case 121 may include the position adjuster 122. The position adjuster 122 may be arranged atone end of the filter case 121. The position adjuster 122 may protrude from an outer surface of the filter case 121 toward the radial direction of the filter 120. The position adjuster 122 may be guided by the case guide 112 of the filter housing 110.

The filter driving device 130 (also referred to as filter driver 130) may rotate the filter 120 to the first position in which the first filter member 126 communicates with the circulation inlet 113 and the circulation outlet 114. The filter driving device 130 may rotate the filter 120 to the second position in which the second filter member 127 communicates with the drain inlet 115 and the drain outlet 116.

The filter driving device 130 may include a filter motor 131, and a filter shaft 132 provided to transmit power of the filter motor 131 to the filter 120. The filter motor 131 may be fixed to the filter housing 110. The filter shaft 132 may be inserted into and fixed to the filter case 121 of the filter 120.

The filter device 100 may include a filter shaft bearing 134 mounted on a portion of the filter case 121 into which the filter shaft 132 is inserted. The filter device 100 may include a shaft sealing member 133 provided to seal a gap between the filter shaft 132 and the filter case 121.

Figure 5:
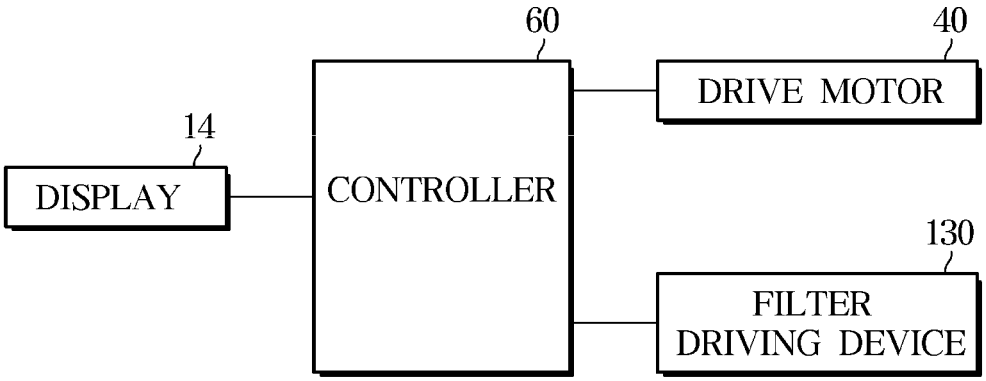
FIG. 5 illustrates a control block diagram of the washing machine shown in FIG. 1.

FIG. 5 illustrates a control block diagram of the washing machine shown in FIG. 1.

Referring to FIG. 5, the washing machine 1 may include a controller 60. The controller 60 may be electrically connected to the display 14. In response to a command inputted from a user through the display 14, the controller 60 may receive the user's command from the display 14.

The controller 60 may be electrically connected to the drive motor 40 and/or the filter driving device 130. The controller 60 may control the drive motor 40 and/or the filter driving device 130 based on the information received from the display 14.

Figure 6:
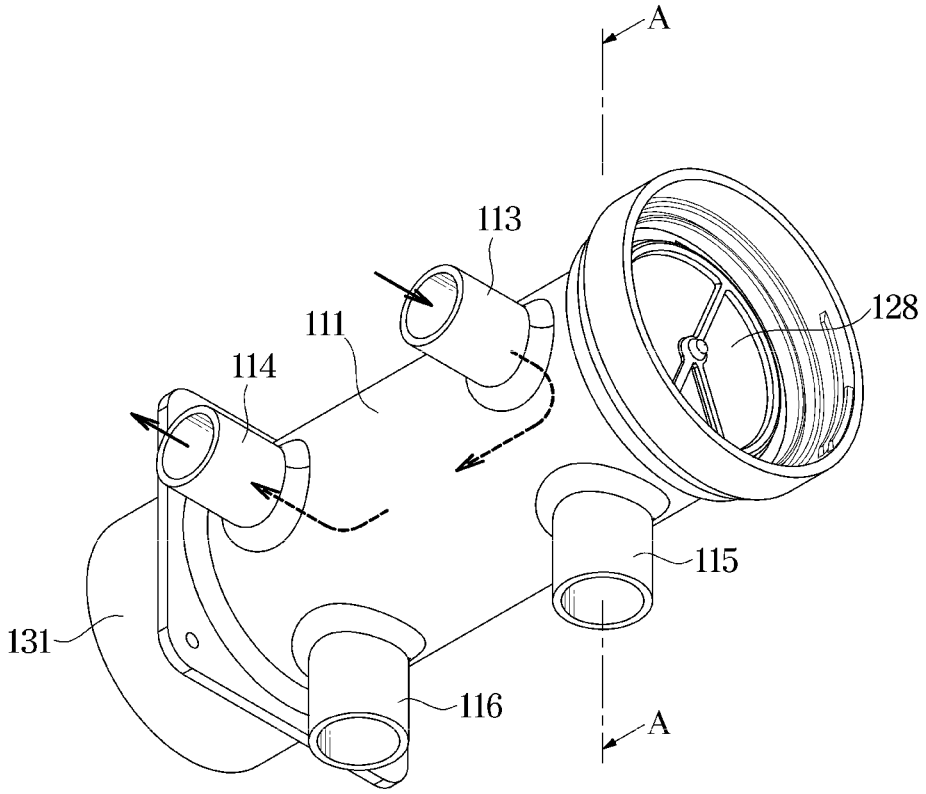
FIG. 6 illustrates a flow of washing water in a state in which the filter shown in FIG. 4 is located in a first position.
Figure 7:
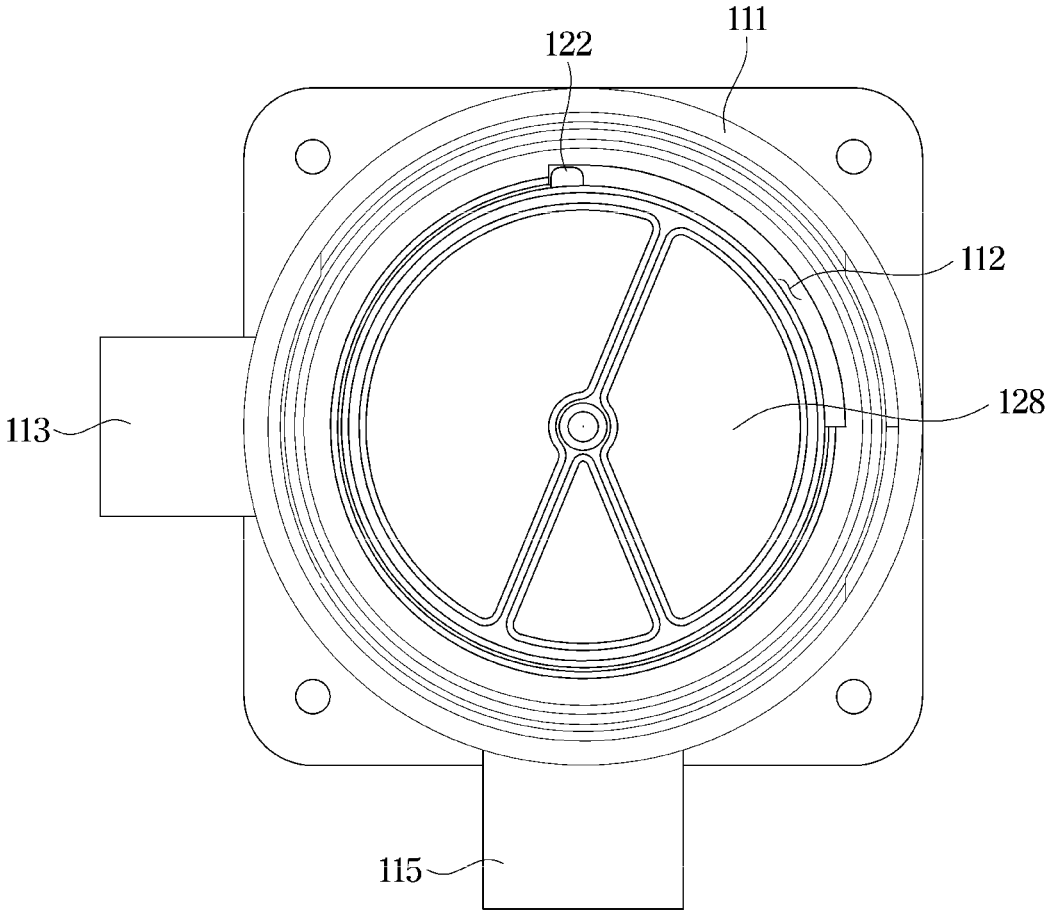
FIG. 7 illustrates a front view of the filter device shown in FIG. 6.
Figure 8:
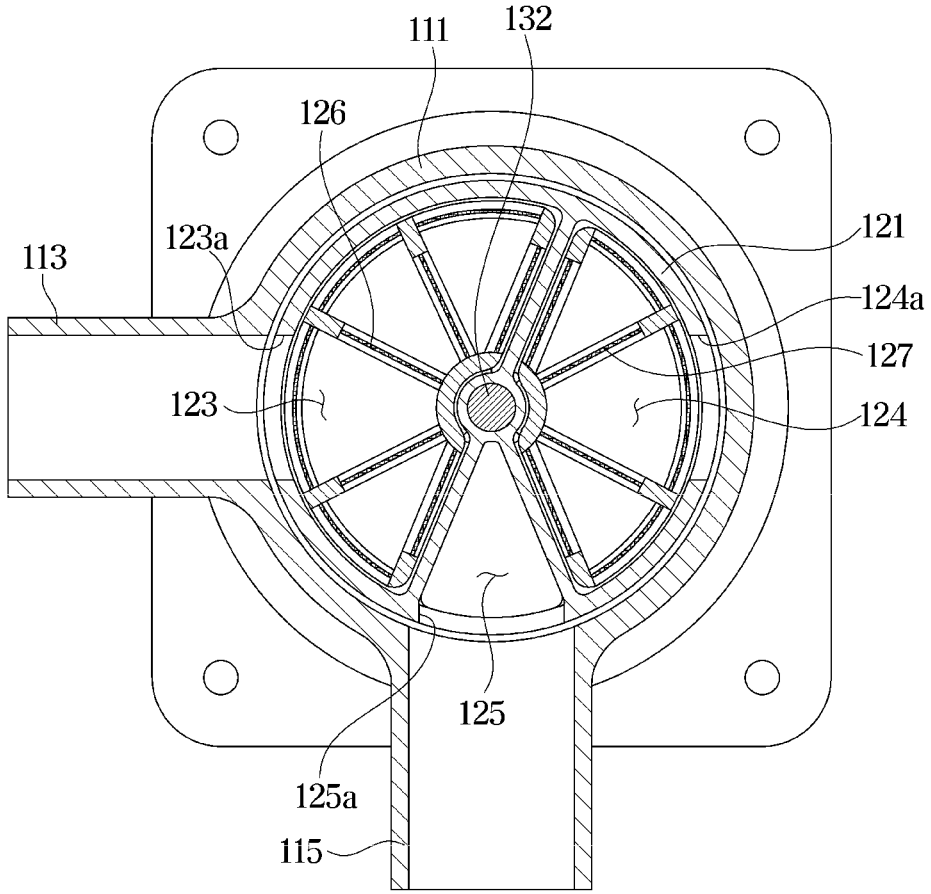
FIG. 8 illustrates a cross-section taken along line A-A shown in FIG. 6.
Figure 9:
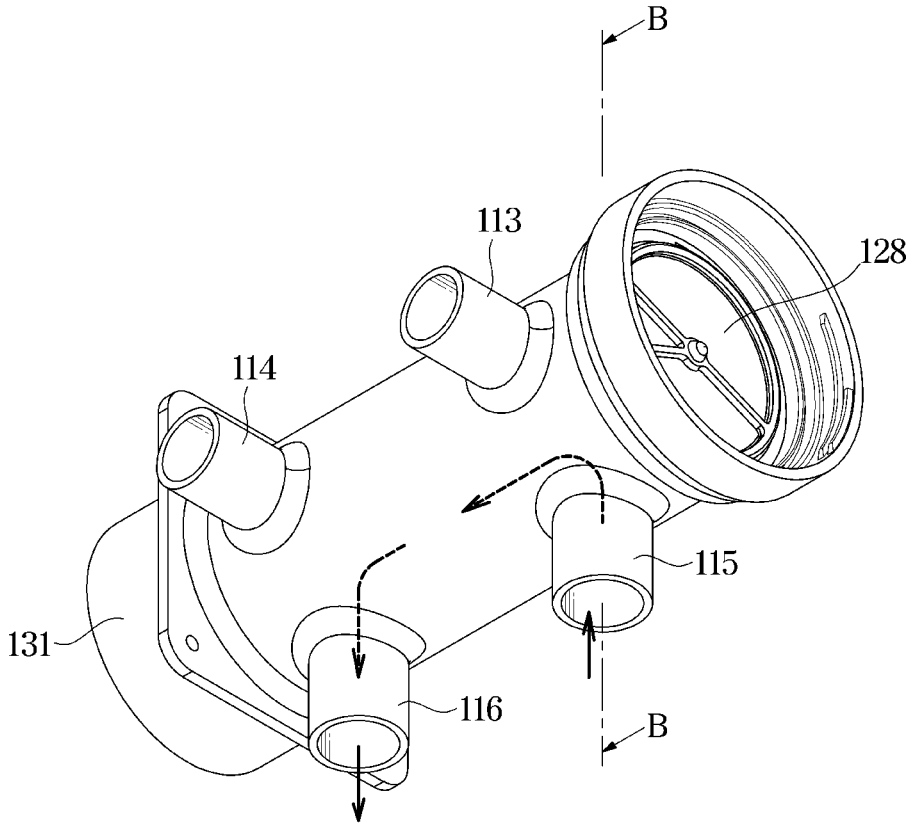
FIG. 9 illustrates a flow of washing water in a state in which the filter shown in FIG. 4 is located in a second position.
Figure 10:
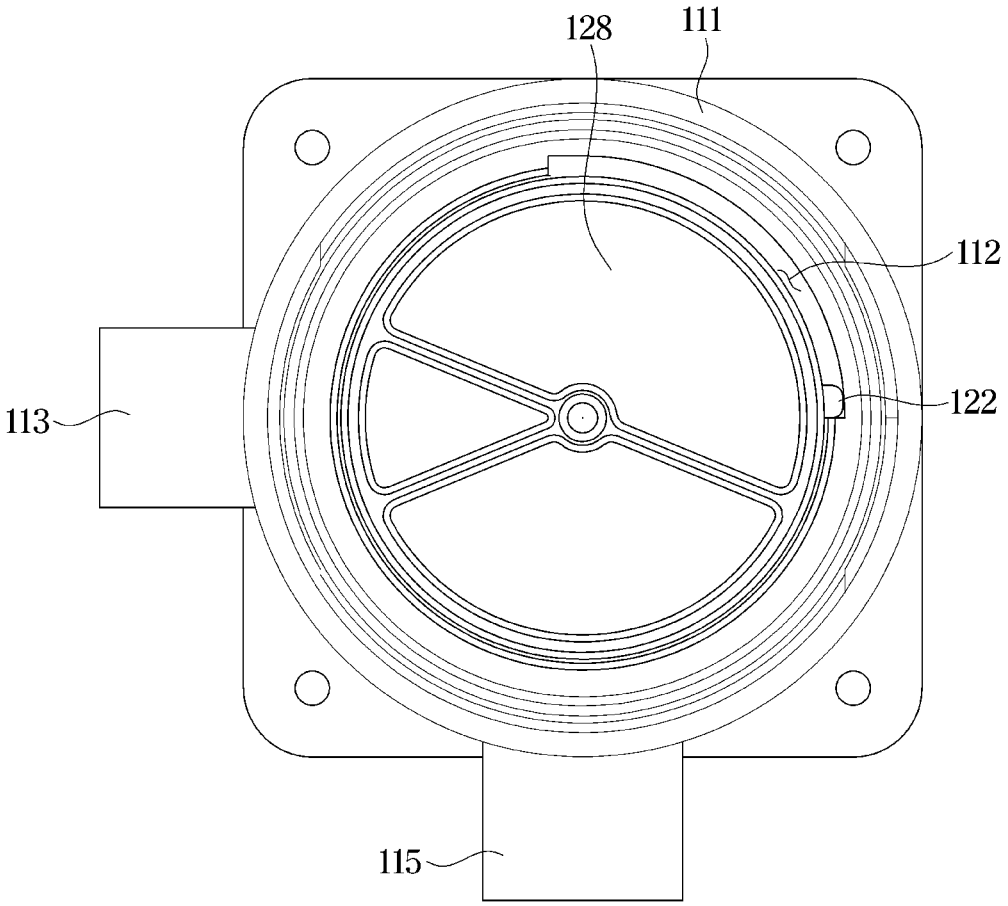
FIG. 10 illustrates a front view of the filter device shown in FIG. 9.
Figure 11:
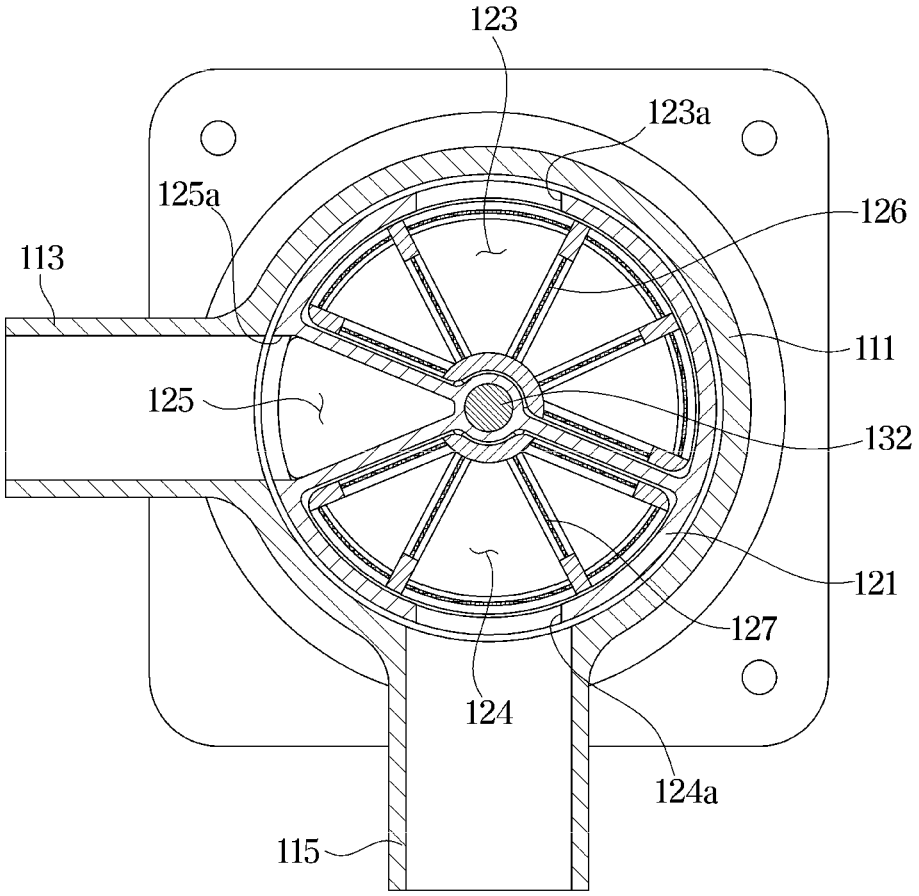
FIG. 11 illustrates a cross-section taken along line B-B shown in FIG. 9.

FIG. 6 illustrates a flow of washing water in a state in which the filter shown in FIG. 4 is located in a first position. FIG. 7 illustrates a front view of the filter device shown in FIG. 6. FIG. 8 illustrates a cross-section taken along line A-A shown in FIG. 6. FIG. 9 illustrates a flow of washing water in a state in which the filter shown in FIG. 4 is located in a second position. FIG. 10 illustrates a front view of the filter device shown in FIG. 9. FIG. 11 illustrates a cross-section taken along line B-B shown in FIG. 9.

An operation of the filter device 100 according to the cycle performed by the washing machine 1 will be described with reference to FIGS. 6 to 11.

Referring to FIGS. 6 to 8, while the washing machine 1 circulates the washing water in the tub 20, the controller 60 controls the filter driving device 130 to rotate the filter 120 to the first position. Particularly, while the washing machine 1 circulates the washing water of the tub 20 in the wash cycle and the rinse cycle, the filter 120 is in the first position. In the first position of the filter 120, the filter 120 may be prevented from being rotated counterclockwise as the case guide 112 guides the position adjuster 122.

In response to the first position of the filter 120, the first filter receiving member 123 may communicate with the circulation inlet 113 and the circulation outlet 114. In response to the first position of the filter 120, the second filter receiving member 124 may not communicate with the drain inlet 115 and the drain outlet 116. In response to the first position of the filter 120, the through-member 125 may communicate with the drain inlet 115 and the drain outlet 116.

Water discharged from the drain pump 80 may flow into the filter 120 through the circulation inlet 113. Water flowing into the filter 120 may be filtered by the first filter member 126. Water filtered by the first filter member 126 may be discharged to the outside of the filter 120 through the circulation outlet 114.

Referring to FIGS. 9 to 11, while the washing machine 1 discharges the washing water from the tub 20 to the outside of the cabinet 10, the controller 60 controls the filter driving device 130 to rotate the filter 130 to the second position. Particularly, while the washing machine 1 discharges the washing water from the tub after performing the wash and rinse cycles, or while the washing machine 1 performs the spin-dry cycle, the filter 120 is in the second position. In the second position of the filter 120, the filter 120 may be prevented from being rotated clockwise as the case guide 112 guides the position adjuster 122.

In response to the second position of the filter 120, the second filter receiving space 124 may communicate with the drain inlet 115 and the drain outlet 116. In response to the second position of the filter 120, the first filter receiving space 123 may not communicate with the circulation inlet 113 and the circulation outlet 114. In response to the second position of the filter 120, the through-member 125 may communicate with the circulation inlet 113 and the circulation outlet 114.

Water discharged from the drain pump 80 may flow into the filter 120 through the drain inlet 115. Water flowing into the filter 120 may be filtered by the second filter member 127. Water filtered by the second filter member 127 may be discharged to the outside of the filter 120 through the drain outlet 116.

On the other hand, in response to the second filter member 127 being blocked while discharging the washing water of the tub 20 to the outside of the cabinet 10, the controller 60 may control the filter driving device 130 to rotate the filter 120 to the first position, thereby allowing the through-member 125 to communicate with the drain inlet 115 and the drain outlet 116, as illustrated in FIG. 8.

With this configuration, the filter device 100 shown in FIGS. 1 to 11 may change the position of the filter 120 including the plurality of filter members 126 and 127 to collect various sizes of foreign substances in response to the cycle performed by the washing machine 1. Therefore, it is possible to increase the life of the filter 120.

Figure 12:
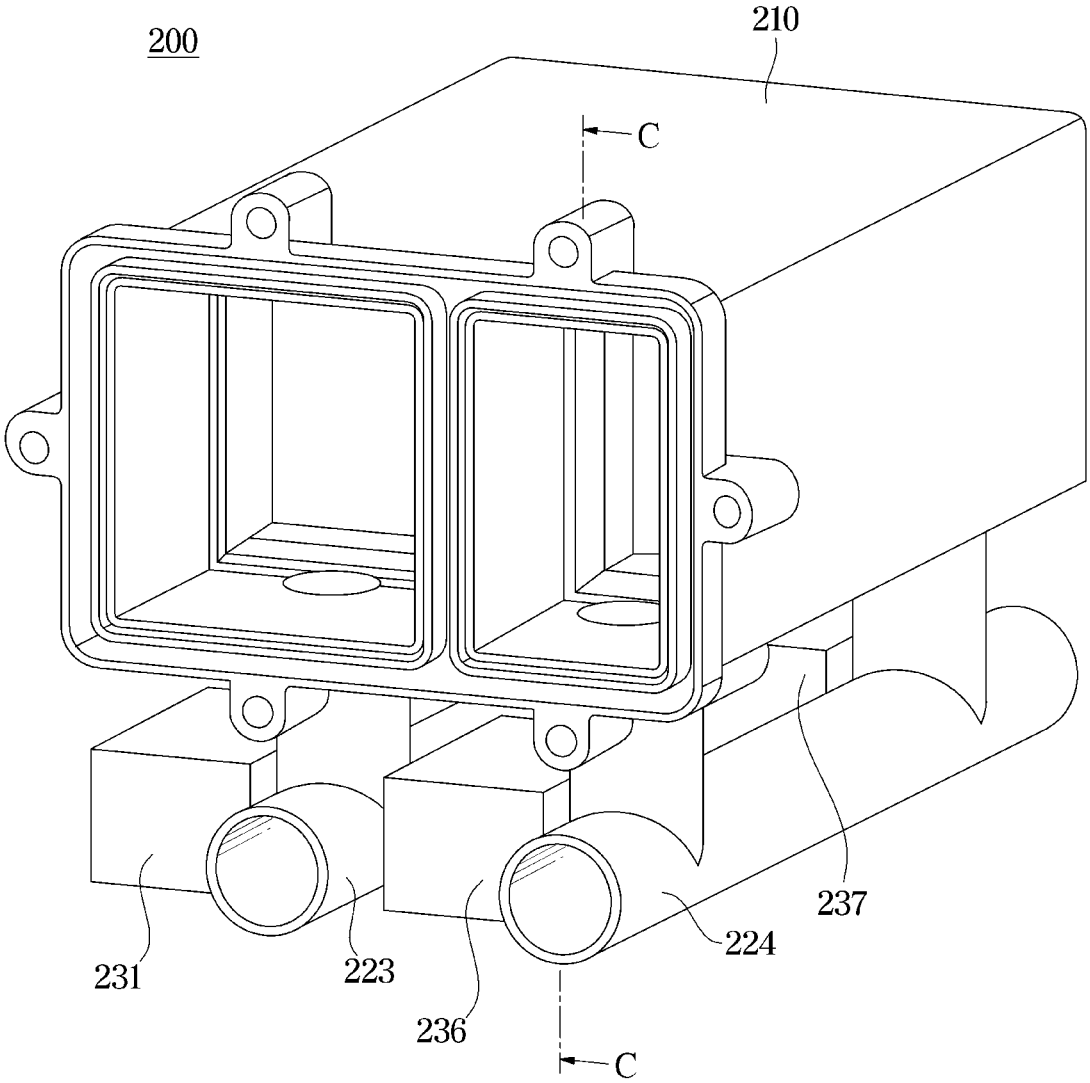
FIG. 12 illustrates a filter device 200 according to another embodiment of the disclosure.
Figure 13:
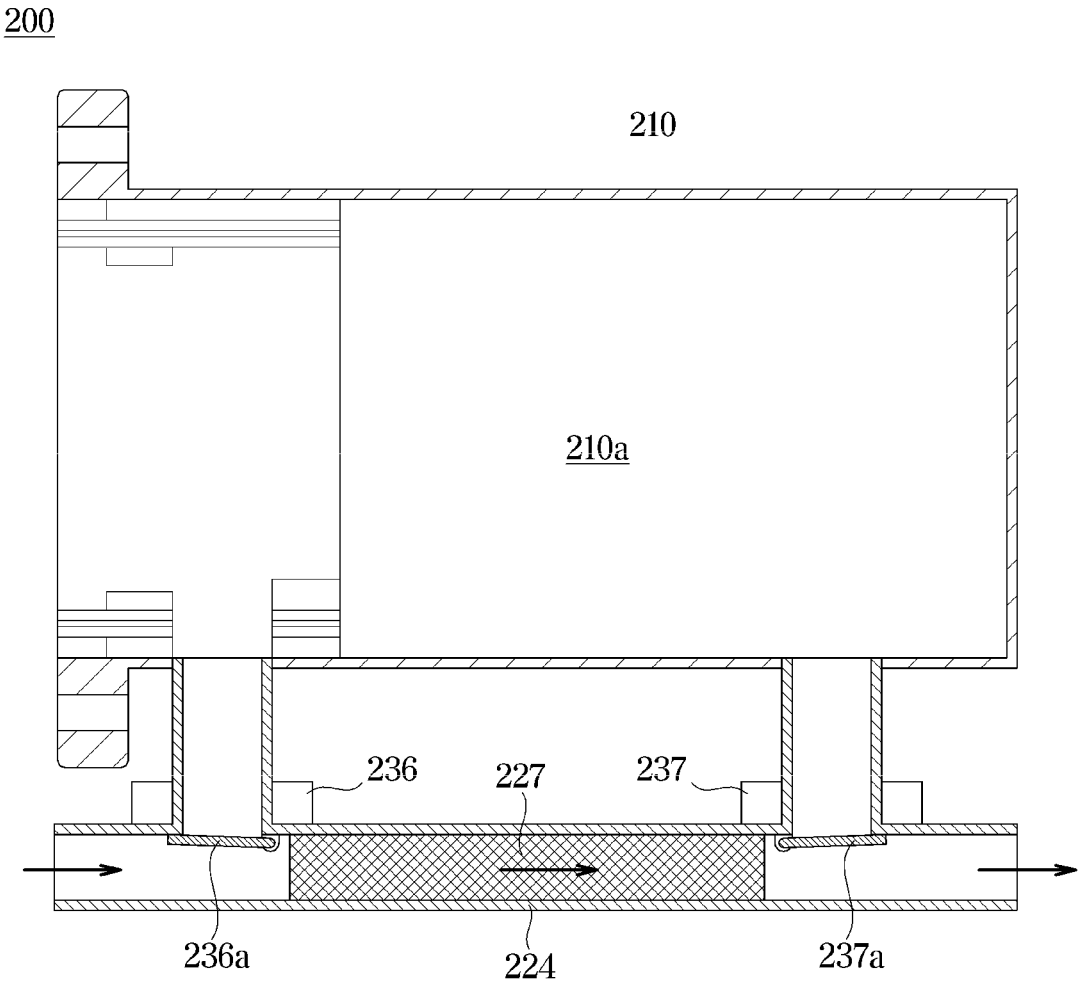
FIG. 13 illustrates a cross-section taken along line C-C shown in FIG. 12, particularly, illustrating a flow of water passing through a filter of the filter device shown in FIG. 12.
Figure 14:
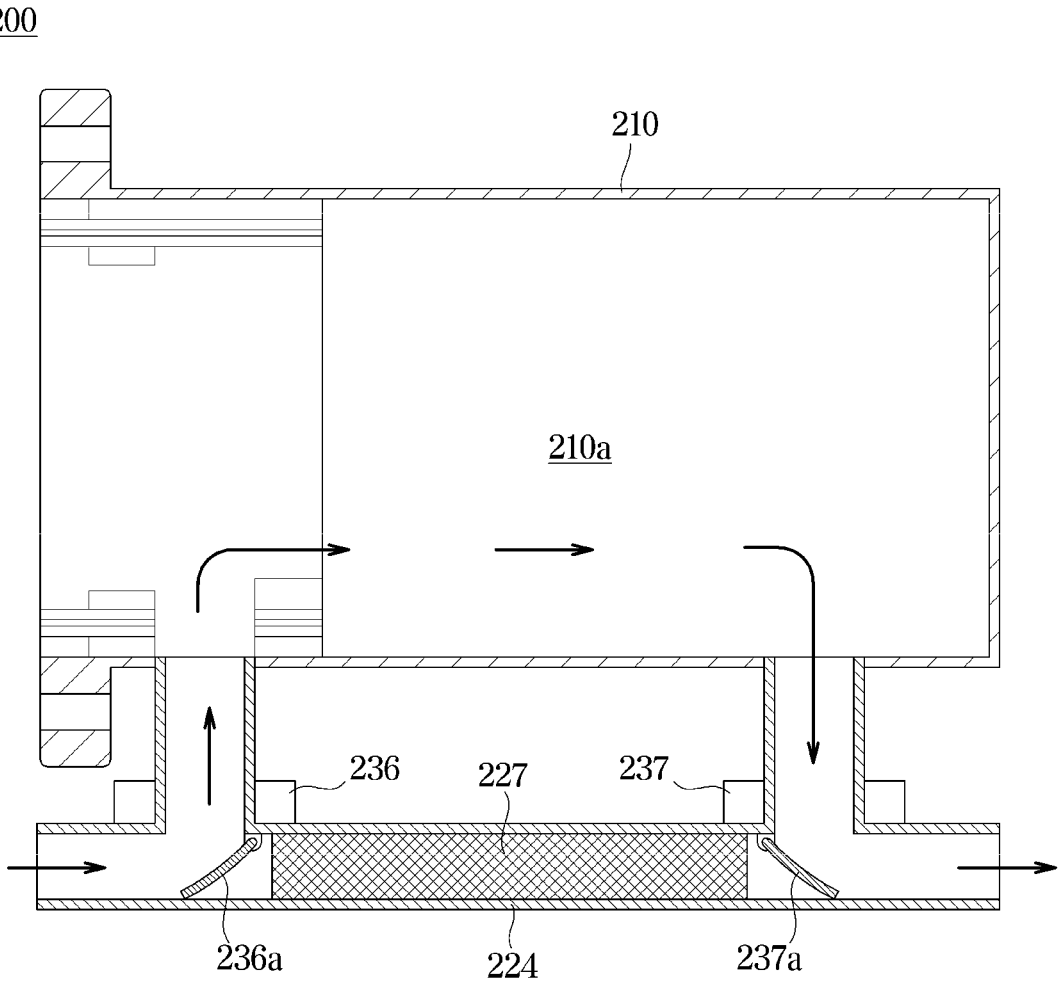
FIG. 14 illustrates a cross-section taken along line C-C shown in FIG. 12, particularly, illustrating a flow of water not passing through the filter of the filter device shown in FIG. 12.

FIG. 12 illustrates a filter device 200 according to another embodiment of the disclosure. FIG. 13 illustrates a cross-section taken along line C-C shown in FIG. 12, particularly, illustrating a flow of water passing through a filter of the filter device shown in FIG. 12. FIG. 14 illustrates a cross-section taken along line C-C shown in FIG. 12, particularly, illustrating a flow of water not passing through the filter of the filter device shown in FIG. 12.

A filter device 200 according to another embodiment of the disclosure will be described with reference to FIGS. 12 to 14. The same reference numerals designate the same components as those of the filter device 100 shown in FIGS. 1 to 11, and detailed descriptions thereof may be omitted.

Referring to FIGS. 12 to 14, the filter device 200 may include a filter housing 210. A bypass flow path 210*a* may be formed inside the filter housing 210.

The filter device 200 may include a first filter driving device 231 configured to open and close the circulation flow path, and second filter driving devices 236 and 237 configured to open and close the drain flow path.

The filter device 200 may include a first filter member 223 forming the circulation flow path and a second filter member 224 forming the drain flow path. An inside of the first filter member 223 and an inside of the second filter member 224 are provided in the same manner. Hereinafter only the second filter member 224 will be described for convenience of description.

Referring to FIGS. 13 and 14, the second filter driving devices 236 and 237 may include a second a (2*a*) filter driving device 236 and a second b (2*b*) filter driving device 237. The second a (2*a*) filter driving device 236 may drive a first damper 236*a*, and the second b (2*b*) filter driving device 237 may drive a second damper 237*a*.

Referring to FIG. 13, in order to allow water flowing into the filter device 200 to pass through the filter 227, the second a (2*a*) filter driving device 236 may drive the first damper 236*a* to open a flow path through which water, which flows to the filter device 200, passes through a filter 227, and the second b (2*b*) filter driving device 237 may drive the second damper 237*a* to allow water passing through the filter 227 to be discharged to an outside of the filter device 200.

Referring to FIG. 14, in order to prevent water flowing into the filter device 200 from passing through the filter 227, the second a (2*a*) filter driving device 236 may drive the first damper 236*a* to allow the water flowing into the filter device 200 to be directed to the bypass flow path 210*a* of the filter housing 210, and the second b (2*b*) filter driving device 237 may drive the second damper 237*a* to allow water passing through the bypass flow path 210*a* to be discharged to the outside of the filter device 200.

Accordingly, in response to the wash cycle, the rinse cycle, or the spin-dry cycle, the filter device 200 shown in FIGS. 12 to 14 may allow water, which is discharged from the drain pump 80, to pass through the circulation flow path or to pass through the drain flow path, thereby collecting various sizes of foreign substances.

Figure 15:
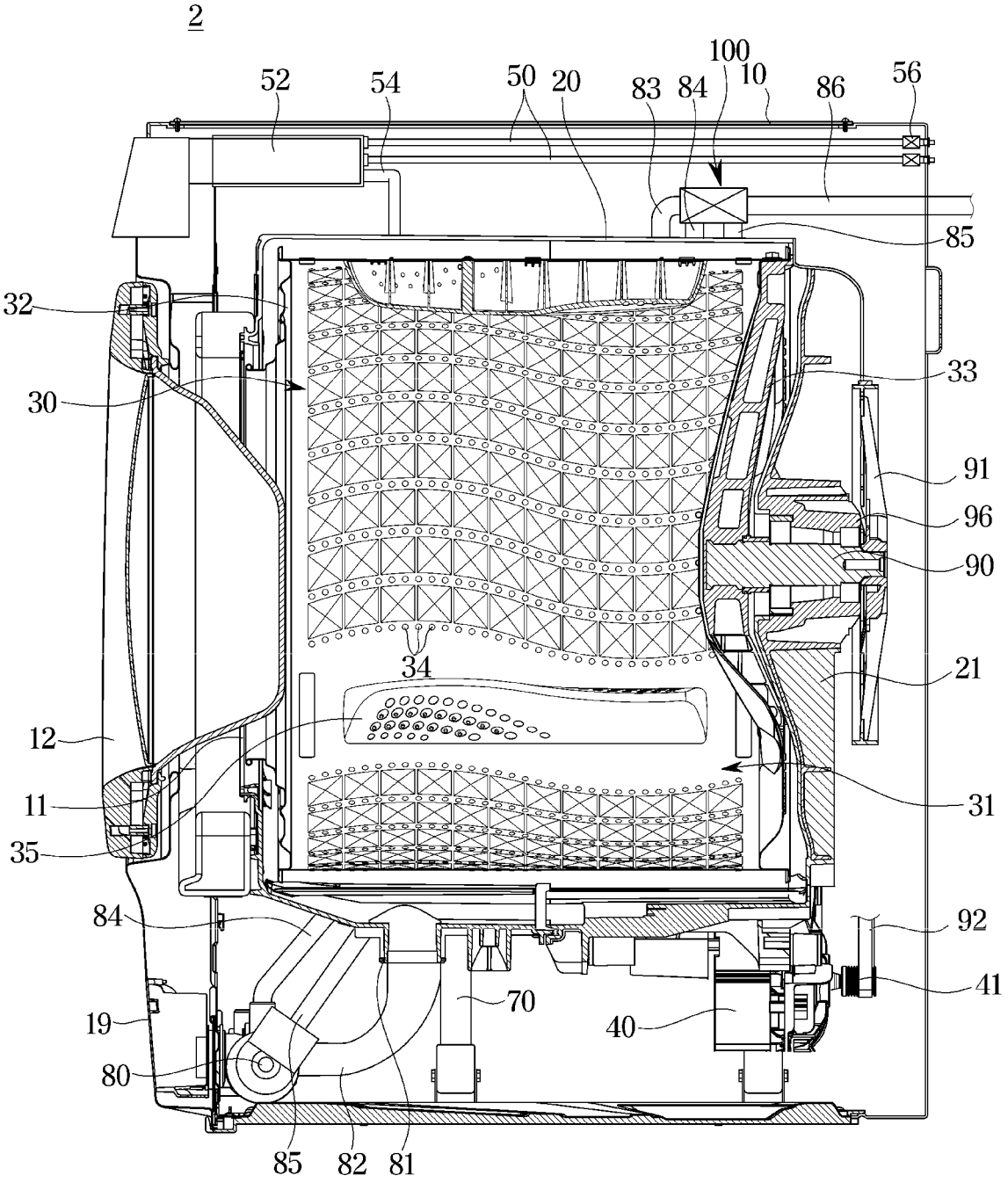
FIG. 15 illustrates a washing machine according to another embodiment of the disclosure.

FIG. 15 illustrates a washing machine according to another embodiment of the disclosure.

Referring to FIG. 15, a washing machine 2 according to another embodiment of the disclosure will be described. The same reference numerals designate the same components as those of the washing machine 1 shown in FIG. 2, and detailed descriptions thereof may be omitted.

Referring to FIG. 15, the washing machine 2 may include the same filter device 100 as the filter device 100 shown in FIG. 2. The filter device 100 may be located at the upper rear side of the tub 20. The drain pump 80 may pump the water, which flows from the tub 20, to the filter device 100. With this configuration, the washing machine 2 shown in FIG. 15 may efficiently arrange the filter device 100 in a limited space inside the cabinet 10.

As is apparent from the above description, a washing machine and a clothes treating apparatus may collect various sizes of foreign substances by including a filter provided with a plurality of filter members.

Further, a washing machine and a clothes treating apparatus may include a controller configured to change a flow path, thereby allowing washing water to selectively pass through one filter member among a plurality of filter members of a filter.

Further, a washing machine and a clothes treating apparatus may include a filter including a plurality of filter members provided to collect various sizes of foreign substances, thereby reducing a space occupied by the filter while maintaining a performance of the filter.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A washing machine comprising:

a tub to receive water;

a drain pump connectable to the tub and configured to discharge the water from the tub while the drain pump is connected to the tub; and a filter assembly to filter water discharged from the drain pump, wherein the filter assembly comprises:

a filter housing;

a filter couplable to the filter housing, the filter including:

a first filter structure to collect foreign substance from the water discharged from the drain pump, and a second filter structure to collect other foreign substances having a size different from foreign substance collected in the first filter structure from the water discharged from the drain pump, the first filter structure and the second filter structure being arranged to face each other inside the filter housing while the filter is coupled to the filter housing; and a filter driver to rotate the filter within the filter housing so that while the filter is rotated to a first position, the water discharged from the drain pump is filtered through the first filter structure and while the filter is rotated to a second position the water discharged from the drain pump is filtered through the second filter structure.

2. The washing machine of claim 1, wherein the filter housing comprises:

a circulation inlet connectable to the drain pump;

a circulation outlet to discharge filtered water introduced through the circulation inlet to the tub;

a drain inlet connectable to the drain pump; and a drain outlet to discharge filtered water introduced through the drain inlet to a drain hose formed to extend to an exterior of the washing machine.

3. The washing machine of claim 2, wherein the filter driver is configured to rotate the filter to a first position in which the first filter structure communicates with the circulation inlet and the circulation outlet, or configured to rotate the filter to a second position in which the second filter structure communicates with the drain inlet and the drain outlet.

4. The washing machine of claim 3, wherein the filter is located in the first position while the water of the tub is circulated; and the filter is located in the second position while the water of the tub is discharged to the exterior of the washing machine.

5. The washing machine of claim 3, wherein the filter comprises a filter case to which the first filter structure and the second filter structure are coupleable and from which the first filter structure and the second filter structure are decouplable, wherein the filter case comprises:

a first filter receiving structure in which the first filter structure is receivable;

a second filter receiving structure in which the second filter structure is receivable, the second filter receiving structure being partitioned from the first filter receiving structure along a circumferential direction of the filter; and a through-member partitioned from the first filter receiving structure and the second filter receiving structure along the circumferential direction of the filter.

6. The washing machine of claim 5, wherein the filter comprises:

a filter cap couplable to and decouplable from the filter case, the filter cap coving the first filter receiving structure, the second filter receiving structure, and the through-member while coupled to the filter case; and a cap sealing structure to seal between the filter case and the filter cap.

7. The washing machine of claim 5, wherein the filter case comprises a position adjuster, wherein the filter housing comprises a case guide to guide the position adjuster to allow the filter to be rotatable between the first position and the second position.

8. The washing machine of claim 5, wherein the through-member is positioned to communicate with the drain inlet and the drain outlet in response to the first position of the filter; and the through-member is positioned to communicate with the circulation inlet and the circulation outlet in response to the second position of the filter.

9. The washing machine of claim 8, wherein the filter is located in the first position to allow the through-member to communicate with the drain inlet and the drain outlet in response to closing the second filter structure while the water of the tub is discharged to the exterior of the washing machine.

10. The washing machine of claim 5, wherein the first filter receiving structure is larger than the second filter receiving structure.

11. The washing machine of claim 10, wherein the through-member is smaller than the second filter receiving structure.

12. The washing machine of claim 5, wherein the filter case comprises:

a first filter inlet formed to correspond to the circulation inlet in response to the first position of the filter;

a first filter outlet formed to correspond to the circulation outlet in response to the first position of the filter;

a second filter inlet formed to correspond to the drain inlet in response to the second position of the filter;

a second filter outlet formed to correspond to the drain outlet in response to the second position of the filter;

a through-inlet formed to correspond to the drain inlet in response to the first position of the filter; and a through-outlet formed to correspond to the drain outlet in response to the first ion of the filter.

13. The washing machine of claim 12, wherein the first filter inlet and the first filter outlet are formed in the first filter receiving structure, the second filter inlet and the second filter outlet are formed in the second filter receiving structure, and the through-inlet and the through-outlet are formed in the through-member.

14. The washing machine of claim 1, wherein the first filter structure is provided to filter out foreign substances from the water discharged from the drain pump having a size larger than that of the second filter structure.

15. The washing machine of claim 1, wherein the filter assembly is arranged below the tub to be adjacent to the drain pump.

* * * * *